US007331769B2

(12) United States Patent
Weis et al.

(10) Patent No.: US 7,331,769 B2
(45) Date of Patent: Feb. 19, 2008

(54) PUMPING SYSTEM

(75) Inventors: Frank G. Weis, Kansas City, MO (US); Robert J. Davis, Peculiar, MO (US)

(73) Assignee: Smith & Loveless, Inc., Lenexa, KS (US)

( * ) Notice: Subject to any disclaimer, the term of this patent is extended or adjusted under 35 U.S.C. 154(b) by 727 days.

(21) Appl. No.: 10/913,159

(22) Filed: Aug. 6, 2004

(65) Prior Publication Data

US 2006/0029504 A1 Feb. 9, 2006

(51) Int. Cl.
*F04B 23/08* (2006.01)
*F04B 49/00* (2006.01)
*F04D 9/00* (2006.01)

(52) U.S. Cl. ..... 417/199.2; 417/200; 417/279

(58) Field of Classification Search ..... 417/199.2, 417/200, 279
See application file for complete search history.

(56) References Cited

U.S. PATENT DOCUMENTS 1,890,319 A * 12/1932 Durdin, Jr. ..... 417/200
3,151,566 A 10/1964 Durstberger
5,035,583 A * 7/1991 Vaught ..... 417/200
2004/0120828 A1* 6/2004 Muhs ..... 417/69

FOREIGN PATENT DOCUMENTS

| | | |
|---|---|---|
| DE | 33 39 679 A1 | 5/1985 |
| DE | 296 00 413 U1 | 3/1996 |
| FR | 921 049 A | 4/1947 |
| GB | 253 205 A | 6/1926 |

* cited by examiner

*Primary Examiner*—Anthony D. Stashick
*Assistant Examiner*—Philip Stimpert
(74) *Attorney, Agent, or Firm*—Wood, Phillips, Katz, Clark & Mortimer

(57) ABSTRACT

A pumping system including a fluid inlet line and a primary pump for the fluid. The primary pump includes an impeller in an impeller chamber, with the impeller chamber adapted to receive fluid from the inlet line. A suction chamber is above the impeller chamber, with a throttle opening between the impeller chamber and the suction chamber. A priming pump is adapted to draw fluid through the throttle opening into the suction chamber. A fluid path is provided around the impeller chamber and between the inlet line and the suction chamber, with the fluid path having a larger area than the throttle opening and including a float restrictor.

14 Claims, 2 Drawing Sheets

PUMPING SYSTEM

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward pumps, and particularly toward vacuum primed pumps.

BACKGROUND OF THE INVENTION AND TECHNICAL PROBLEMS POSED BY THE PRIOR ART

Pumps for liquids or fluids, often having non-microscopic solid particles therein, are well known in the art, and commonly use a rotary or centrifugal action to mechanically impel the fluid in the desired direction.

Typically such pumps are vacuum primed and are positioned above the level of the liquid being pumped. In such installations, the pump will not operate properly unless there is a head of fluid from the lower liquid level into the pump itself. That is, if the fluid does not reach into the pump, the pump will merely drive air and will not create a sufficient force to draw the fluid up to the pump for the desired pumping. Therefore, such pumps are primed with fluid to ensure that there is the desired head of fluid extending into the pump so that it may operate as desired. Moreover, it is important that the pump impeller, mechanical seal or packing be completely submerged in order to prevent air from being entrained in the pump and potentially air locking the impeller to prevent pump operation. This has typically been accomplished by providing a separate vacuum pump, connected to the primary pump at its highest point, to ensure that all air is extracted as desired.

Such separate vacuum pumps must, however, typically be connected to the pressure side of the primary pump, with a valve of some type provided in the vacuum line to the separate vacuum pump to prevent pressurized fluid from entering, and potentially damaging, the separate vacuum pump. In pumps with automatic operation, such valves have, for example, been solenoid valves or the like. However, such valves are prone to leaking after frequent operation, in which case the pressurized water will still force its way through the valve and therefore still potentially damage the separate vacuum pump. Further, such valves cannot be opened while the pump is in operation or the water from the primary pump will undesirably be forced into the separate vacuum pump.

The present invention is directed toward overcoming one or more of the problems set forth above.

SUMMARY OF THE INVENTION

In one aspect of the present invention, a pumping system is provided, including a primary pump for pumping fluid from an inlet out an outlet, the primary pump including a pumping chamber adapted to receive fluid from the inlet, a suction chamber disposed above the pumping chamber, a throttle opening between the pumping chamber and the suction chamber, and a priming pump for drawing fluid into the suction chamber. A fluid path is provided around the pumping chamber between the inlet and the suction chamber, with the fluid path having a larger area than the throttle opening. A flow restrictor selectively restricts flow of fluid from the fluid path to the suction chamber, with the flow restrictor further selectively permitting flow of fluid from the suction chamber to the inlet during operation of the primary pump, where the rate of the selectively permitted fluid flow from the suction chamber to the inlet is at least as great as the rate of flow of fluid through the throttle opening during primary pump operation.

In one form of this aspect of the invention, a sensor for fluid level is provided in the suction chamber, and the priming pump operates responsive to the sensor.

In another form of this aspect of the invention, a check valve is between the priming pump and the suction chamber.

In still another form of this aspect of the invention, the priming pump is a vacuum pump.

In yet another form of this aspect of the invention, the flow restrictor is a floating member in the fluid path below a seal opening between the suction chamber and the flow path, and the fluid supports the floating member against the seal opening to restrict fluid flow from the fluid path to the suction chamber. In a further form, the buoyant force of the floating member in the fluid may be overcome to unseat the floating member from the seal opening by pressure differential between the suction chamber and the fluid path during operation of the primary pump.

In another aspect of the present invention, a pumping system is provided, including a fluid inlet line, a primary pump for the fluid, the primary pump including an impeller in an impeller chamber, the impeller chamber adapted to receive fluid from the inlet line, a suction chamber disposed above the impeller chamber, a throttle opening between the impeller chamber and the suction chamber, a secondary pump for drawing fluid through the throttle opening into the suction chamber, and a fluid path around the impeller chamber and between the inlet line and the suction chamber, the fluid path having a larger area than the throttle opening and including a float restrictor.

In one form of this aspect of the invention, a sensor for fluid level is provided in the suction chamber, and the secondary pump operates responsive to the sensor.

In another form of this aspect of the invention, a check valve is provided between the secondary pump and the suction chamber.

In still another form of this aspect of the invention, the secondary pump is a vacuum pump.

In yet another form of this aspect of the invention, the float restrictor substantially restricts fluid flow from the fluid path to the suction chamber.

In a still further form of this aspect of the invention, during operation of the primary pump, the float restrictor allows flow of fluid through the fluid path from the suction chamber to the inlet line.

In yet another form of this aspect of the invention, the float restrictor comprises a floating member in the fluid path below a seal opening, and the fluid supports the floating member against the seal opening to restrict fluid flow from the fluid path to the suction chamber. In a further form, the buoyant force of the floating member in the fluid may be overcome to unseat the floating member from the seal opening by pressure differential between the suction chamber and the fluid path during operation of the primary pump.

DETAILED DESCRIPTION OF THE INVENTION

Figure 1:
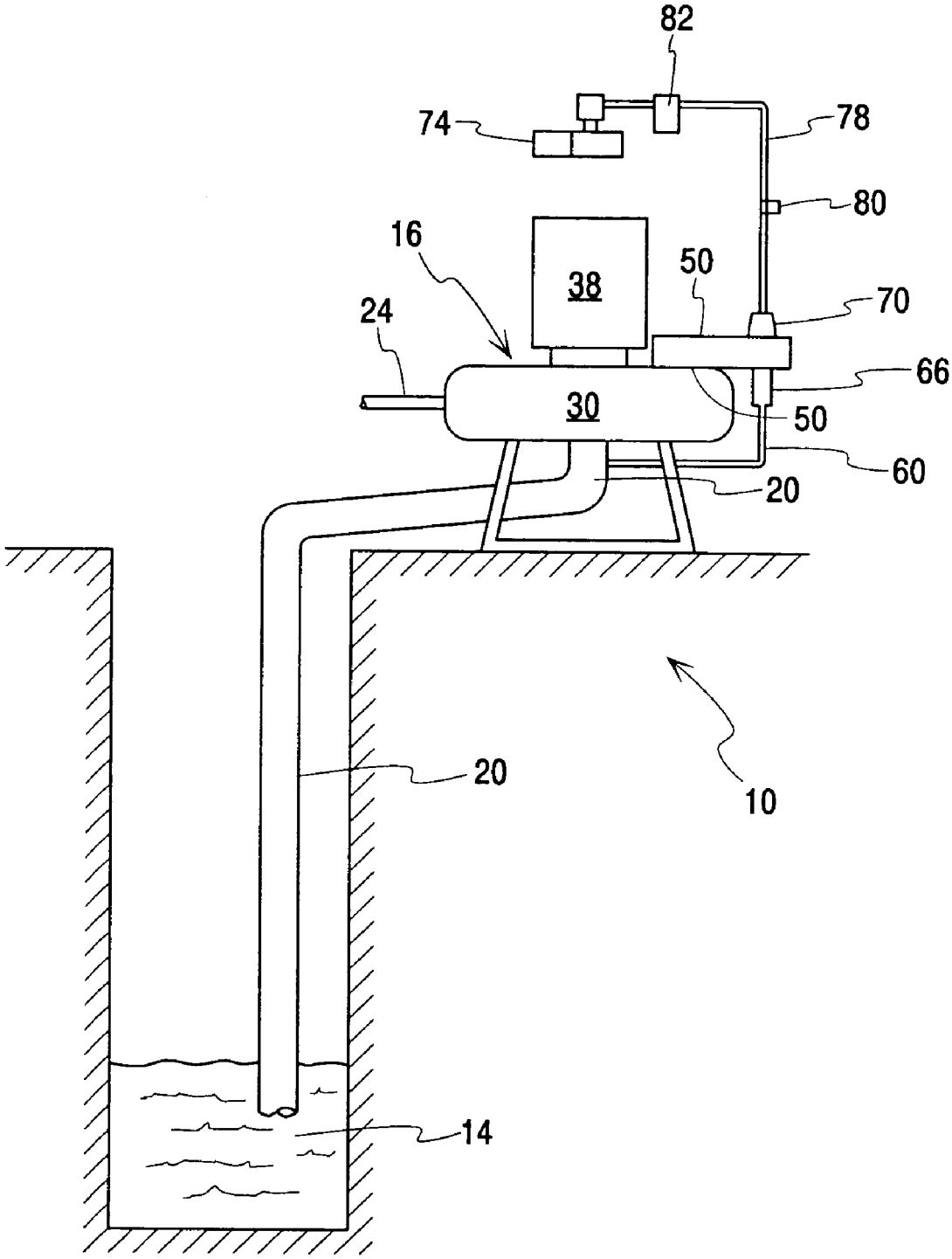
FIG. 1 is a schematic diagram of a pumping system embodying the present invention in an installation.

A pumping system 10 according to the present invention is shown in FIG. 1 as installed at a location for pumping fluid 14 from a level beneath the pump 16.

The pump 16 is connected to the fluid 14 by an inlet line 20 such as a tube or pipe. The inlet line 20 is a suction line which is an connected to the bottom of the pump 16 whereby fluid 14 may be drawn up into the pump 16 for pumping from a pump outlet 24.

Figure 2:
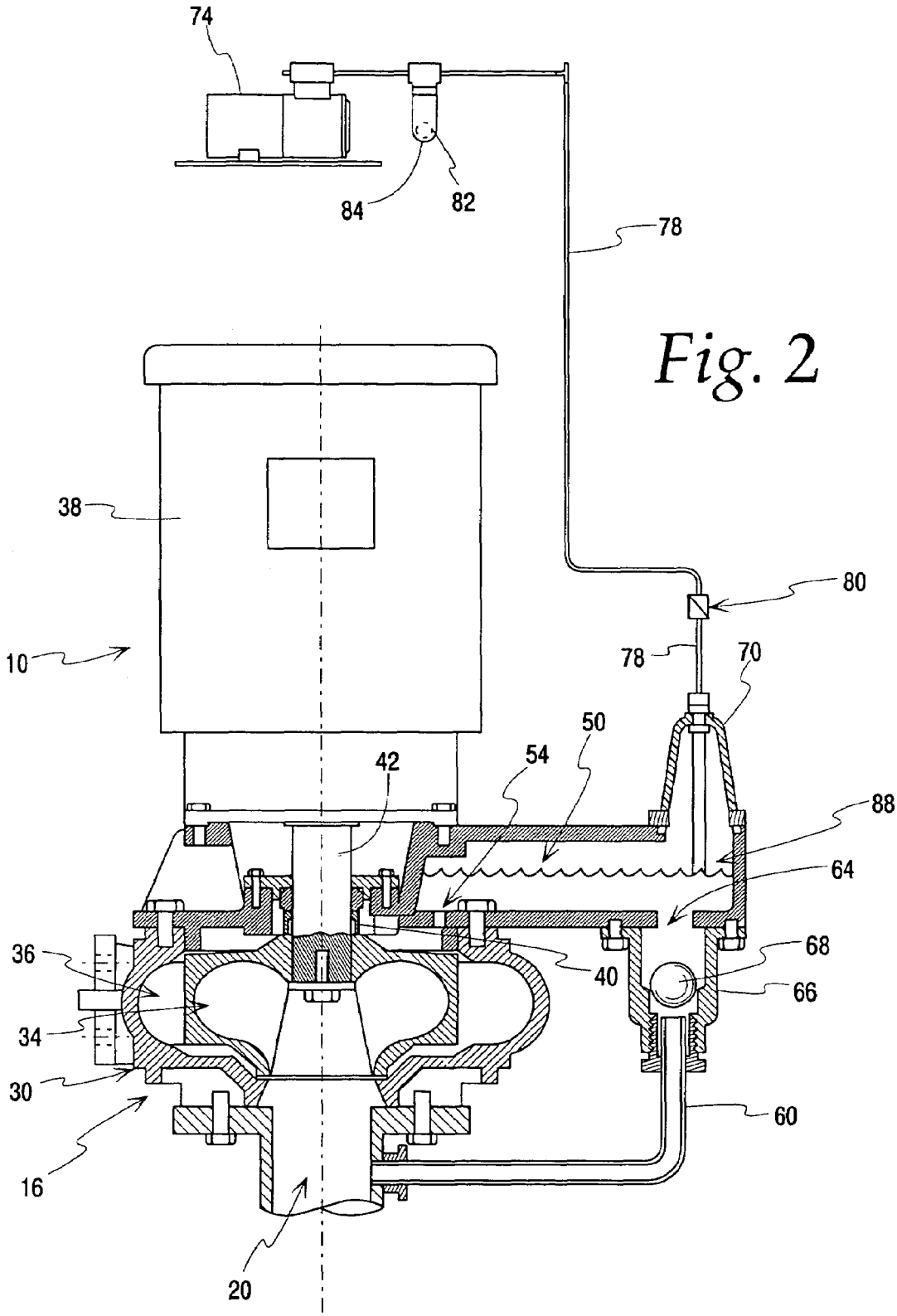
FIG. 2 is a cross-sectional view of a preferred embodiment of a pump usable with the present invention.

The pump 16 illustrated particularly in FIG. 2 includes a suitable housing such as volute 30 having an impeller 34 rotatably driven in an impeller or pumping chamber 36 by a suitable motor 38. A suitable seal 40 is provided around the drive shaft 42 of the motor 38 to seal the motor 38 from the volute 30. It should be understood, however, that the present invention may be used with a wide variety of primed pumps, and that the details of the pump 16 illustrated in the Figures are merely examples of one such pump with which the invention may be advantageously used with the present invention.

A suction or primer chamber 50, which may be a part of the adapter for the pump motor 38 and volute 30, is defined above the volute 30, and is used to draw priming fluid into the pump 16 as described below. A throttle opening 54 is provided between the suction chamber 50 and the pumping chamber 36.

A bypass line or fluid path 60 is provided between the inlet line 20 and the suction chamber 50, with the bypass line 60 having a greater cross section than the throttle opening 54. A seal opening 64 is disposed at the upper end of the bypass line 60.

A flow restrictor 66 is provided in the bypass line 60 beneath the seal opening 64. The flow restrictor 66 includes a ball float 68. With fluid present in the bypass line 60 and suction chamber 50, the ball float 68 is generally forced by the buoyant force of the fluid against the seal opening 64 to block the inlet line 20 from the suction chamber 50. However, should a greater pressure arise in the suction chamber 50 than in the bypass line 60, that pressure differential may advantageously overcome the buoyant force on the ball float 68 and unseat it from the seal opening 64 to allow fluid to move from the suction chamber 50 to the bypass line 60 as described below.

A clear plastic housing dome 70 may be provided above the suction chamber 50 to allow for visual inspection into the dome 70. A suitable secondary or priming vacuum pump 74 is connected to the dome 70 by a vacuum line 78. As described below, the vacuum pump 74 may be selectively operated to prime the primary pump 16. It should be appreciated that any secondary pump 74 capable of generating a vacuum sufficient to prime the primary pump 16, such as described below, will be suitable. A check valve 80 and float check valve 82 with a drain 84 may be provided in the vacuum line 78 to assist in preventing fluid from being drawn into the vacuum pump 74.

A suitable sensor 88 is also provided to detect the fluid level in the suction chamber 50. As illustrated, the sensor 88 is in the dome 70, but it should be appreciated that the sensor 88 could be placed at many different locations in the suction chamber 50 within the scope of the present invention. It should be appreciated that the sensor 88 may be variously positioned relative to the pump 16, with the design requirement being that the sensor 88 be positioned so that it will be able to detect when an adequate level of primer fluid is not present for operation of the pump 16.

Operation of the pumping system 10 is as follows.

If the fluid level is lower than desired in the pump 16 for pump operation, the vacuum pump 74 and check valve 80 will be operated to generate a vacuum in vacuum line 78 and in turn generate a vacuum in suction chamber 50. The vacuum in suction chamber 50 will, in turn, draw fluid up through throttle opening 54 and bypass line 60 from input line 20.

Once the fluid has reached into the suction chamber 50, the ball float 68 will be raised against the seal opening 64, whereby substantially all of the additional fluid drawn up into the suction chamber 50 will come through the throttle opening 54. With the throttle opening 54 located above the impeller chamber 36, this will ensure that the impeller chamber 36 will be completely filled with fluid as is desired for proper operation of the pump 16.

When the fluid level reaches the sensor 88 to indicate the presence of a sufficient amount of fluid, the priming pump 74 may be turned off and/or the check valve 80 closed (closing of the valve 80 may be automatic in response to shutting off of the vacuum pump). A suitable controller (not shown) for the system 10 may similarly be signaled that the pump 16 is ready for proper operation when pumping is desired.

During operation of the pump 16, a high pressure surge of fluid into the suction chamber 50 will be restricted by the throttle opening 54. Moreover, to the extent that a high pressure might tend to develop in the suction chamber 50, the raised pressure will unseat the ball float 68 (i.e., move the ball float 68 down against the buoyant force supporting it) so that the pressure may be released back through the fill line 60 to the inlet line 20 rather than undesirably forcing fluid to leak through the check valve 80 and into the priming pump 74 and potentially damaging the pump 74. Further, given the greater area of the sealing opening 64 and the bypass line 60 relative to the area of the throttle opening 54, such pressure release may be easily accomplished.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A pumping system, comprising:

a primary pump for pumping a fluid from an inlet out an outlet, said primary pump including a pumping chamber adapted to receive fluid from said inlet;

a suction chamber disposed above said pumping chamber;

a throttle opening between said pumping chamber and said suction chamber;

a priming pump for drawing fluid into said suction chamber;

a fluid path around said pumping chamber between said inlet and said suction chamber, said fluid path having a larger area than said throttle opening; and a flow restrictor selectively restricting flow of fluid from said fluid path to said suction chamber, said flow restrictor further selectively permitting flow of fluid from said suction chamber to said inlet during operation of said primary pump, the rate of said selectively permitted fluid flow from said suction chamber to said inlet being at least as great as the rate of flow of fluid through said throttle opening during primary pump operation.

2. The pumping system of claim 1, further comprising a sensor for fluid level in said suction chamber, said priming pump operating responsive to said sensor.

3. The pumping system of claim 1, further comprising a check valve between said priming pump and said suction chamber.

4. The pumping system of claim 1, wherein said priming pump is a vacuum pump.

5. The pumping system of claim 1, wherein said flow restrictor comprises a floating member in said fluid path below a seal opening between said suction chamber and said fluid path, and said fluid supports said floating member against said seal opening to restrict fluid flow from said fluid path to said suction chamber.

6. The pumping system of claim 5, wherein the buoyant force of said floating member in the fluid may be overcome to unseat the floating member from said seal opening by pressure differential between the suction chamber and the fluid path during operation of said primary pump.

7. A pumping system, comprising:

a fluid inlet line;

a primary pump for a fluid, said primary pump including an impeller in an impeller chamber, said impeller chamber adapted to receive fluid from said inlet line;

a suction chamber disposed above said impeller chamber;

a throttle opening between said impeller chamber and said suction chamber;

a secondary pump for drawing fluid through said throttle opening into said suction chamber;

a fluid path around said impeller chamber and between said inlet line and said suction chamber, said fluid path having a larger area than said throttle opening and including a float restrictor.

8. The pumping system of claim 7, further comprising a sensor for fluid level in said suction chamber, said secondary pump operating responsive to said sensor.

9. The pumping system of claim 7, further comprising a check valve between said secondary pump and said suction chamber.

10. The pumping system of claim 7, wherein said secondary pump is a vacuum pump.

11. The pumping system of claim 7, wherein said float restrictor substantially restricts fluid flow from said fluid path to said suction chamber.

12. The pumping system of claim 7, wherein, during operation of said primary pump, said float restrictor allows flow of fluid through said fluid path from said suction chamber to said inlet line.

13. The pumping system of claim 7, wherein said float restrictor comprises a floating member in said fluid path below a seal opening, and said fluid supports said floating member against said seal opening to restrict fluid flow from said fluid path to said suction chamber.

14. The pumping system of claim 13, wherein the buoyant force of said floating member in the fluid may be overcome to unseat the floating member from said seal opening by a pressure differential between the suction chamber and the fluid path during operation of said primary pump.

* * * * *